United States Patent [19]

Fishter et al.

[11] 4,274,908

[45] Jun. 23, 1981

[54] CYANIDE FREE SOLUTION AND PROCESS FOR REMOVING GOLD-NICKEL BRAZE

[75] Inventors: Robert E. Fishter, Boca Raton; Brian A. Manty, Lake Park, both of Fla.

[73] Assignee: United Technologies Corporation, Hartford, Conn.

[21] Appl. No.: 150,276

[22] Filed: May 15, 1980

Related U.S. Application Data

[63] Continuation of Ser. No. 933,944, Aug. 15, 1978, abandoned.

[51] Int. Cl.[3] ..... C09K 13/04; C23F 1/00

[52] U.S. Cl. ..... 156/637; 75/97 A; 75/101 R; 75/118 R; 75/119; 156/664; 252/79.2

[58] Field of Search ..... 156/637, 638, 664; 252/79.2; 75/97 A, 101 R, 104, 118 R, 118 P, 119

[56] References Cited

U.S. PATENT DOCUMENTS

| | | | |
|---|---|---|---|
| 2,200,486 | 5/1940 | Burdick | 75/101 R |
| 2,684,892 | 1/1954 | Saulnier | 156/664 |
| 3,242,090 | 3/1966 | Grunwald | 156/664 |
| 3,399,143 | 8/1968 | Slominski | 252/79.2 |
| 3,583,867 | 6/1971 | Slominski et al. | 75/119 |
| 3,856,507 | 12/1974 | Brug et al. | 75/118 R |
| 3,856,694 | 12/1974 | Becking | 252/79.2 |
| 3,958,984 | 5/1976 | Fountain | 75/118 R |
| 4,042,451 | 8/1977 | Lash et al. | 156/664 |
| 4,048,006 | 9/1977 | Harbulak et al. | 156/664 |
| 4,154,791 | 5/1979 | Howells et al. | 252/79.2 |

FOREIGN PATENT DOCUMENTS

| | | | |
|---|---|---|---|
| 2103261 | 10/1972 | Fed. Rep. of Germany | 156/664 |

OTHER PUBLICATIONS

Flitsch, "Etch for Removing Gold" IBM Technical Disclosure Bulletin vol. 10, No. 4, (9/67) p. 355.

*Primary Examiner*—Jerome W. Massie
*Attorney, Agent, or Firm*—Charles E. Sohl

[57] ABSTRACT

An effective cyanide free solution and process for removing gold-nickel braze alloys from superalloy parts are described. The solution contains about 50% nitric acid with intentional additions of materials which ionize to provide chloride ions, sulfate ions, and metal ions in specific concentrations.

6 Claims, No Drawings

CYANIDE FREE SOLUTION AND PROCESS FOR REMOVING GOLD-NICKEL BRAZE

This is a continuation of application Ser. No. 933,944 filed on Aug. 15, 1978, now abandoned.

The invention herein described was made in the course of or under a contract or subcontract with the Department of the Air Force.

BACKGROUND OF THE INVENTION

1. Field of the Invention

This invention relates to solutions and processes for chemically removing braze alloys from superalloy parts.

2. Description of the Prior Art

It is known in the art to remove various braze alloys including gold-nickel braze alloys from various substrate alloys using cyanide containing alkaline solutions. At least one patent, U.S. Pat. No. 3,958,984, teaches the use of a cyanide containing alkaline solution in combination with a second acid solution.

In a somewhat different art area, U.S. Pat. Nos. 3,399,143 and 3,367,874 relate to the removal of nickel plate from articles such as plating racks. U.S. Pat. No. 3,856,694 teaches the use of a nitric acid solution containing chloride, copper and tellurium or selenium ions to remove nickel plate from plating apparatus.

SUMMARY OF THE INVENTION

A method is described for removing a gold-nickel braze alloy from superalloy parts. The method employs a solution which contain from about 30 to about 60% nitric acid, 0.005 to 0.15 moles per liter sulfate ions, and from 0.001 to 0.4 moles per liter chloride ions. The chloride and sulfate ions are preferably derived from metal salts. Metal ions are preferably present in the solution in concentrations of at least about 0.001 moles/liter. This solution is used at a temperature of about 120°-150° F. and the part from which the braze is to be removed is immersed in the solution for a period of several hours. Ultrasonic agitation may be used to accelerate the process. The process has been found to be effective in removing gold-nickel braze alloys from a variety of nickel and cobalt superalloy and stainless steel substrates without any measurable substrate attack.

The foregoing and other objects, features and advantages of the present invention will become more apparent in the light of the following detailed description of preferred embodiments thereof.

DESCRIPTION OF PREFERRED EMBODIMENTS

The present invention relates to a process and solution for removing certain braze alloys from superalloys and stainless steel parts. The process is cyanide free and thus is desirable from environmental and employee safety points of view. The solution is also quite specific to the gold-nickel braze alloys and produces no measurable attack of the parts from which the braze material is being removed. Specific braze alloys which have been successfully removed by the present invention are those based on gold which contain from about 10 to about 30% nickel. Specific braze alloys are listed in Table I. Braze alloys of these compositions have successfully been removed from a variety of nickel base superalloys including those whose compositions are listed in Table II. Gold-nickel braze has also been removed from cobalt base alloys whose compositions are listed in Table II. Finally, a successful removal of gold-nickel braze material from stainless steels of the 410 and 347 types has been achieved.

The essential ingredients of the solution include from 30 to 60% nitric acid by weight, from 0.005 to 0.15 moles per liter of sulfate ions and from 0.001 to 0.4 moles per liter of chloride ions, balance water. The preferred ranges are 40 to 50% nitric acid, 0.01 to 0.1 moles per liter sulfate and 0.005 to 0.2 moles per liter chloride ions. These ions are preferably obtained from ionizable metal containing compounds and preferably metal ions are present in the solution in concentrations of at least 0.001 moles per liter and preferably 0.05 moles per liter. Solutions in which the chloride and sulfate ions are derived from acids such as hydrochloric and sulfuric have been evaluated. Such solutions must be rather dilute if base metal attack is to be avoided and, therefore, these solutions are slow acting. Solutions which contain metal ions can be more concentrated without causing base metal attack. Consequently, these solutions remove braze metal more rapidly and thus are preferred.

It is believed that the nitric acid and chloride ions dissolve the gold constituent of the braze material in a fashion similar to the way in which aqua regia dissolves gold. The nitric acid dissolves the nickel component of the braze material. It is believed that the sulfate ion may form a complex with the gold thereby speeding the rate of dissolution.

TABLE I

| AMS No. | Au | Pd | Ni |
|---|---|---|---|
| 4784 | 50 | 25 | 25 |
| 4785 | 30 | 34 | 36 |
| 4786 | 70 | 8 | 22 |
| 4787 | 82 | — | 18 |

TABLE II

1. Waspalloy: 0.07 C, 19.5 Cr, 13.5 Co, 4.3 Mo, 3 Ti, 1.4 Al, 0.006 B, 0.09 Zr, Bal Ni.
2. Hastelloy X: 0.1 C, 0.5 Mn, 0.5 Si, 22 Cr, 1.5 Co, 9 Mo, 0.6 W, 18.5 Fe, Bal Ni.
3. IN 100: 0.18 C, 10 Cr, 15 Co, 3 Mo, 4.7 Ti, 5.5 Al, 0.014 B, 0.06 Zr, 1 V, Bal Ni.
4. MAR-M-200: 0.15 C, 9 Cr, 10 Co, 12.5 W, 1 Cb, 2 Ti, 5 Al, 0.015 B, 0.05 Zr, Bal Ni.
5. Astrolloy: 0.06 C, 15 Cr, 15 Co, 5.25 Mo, 3.5 Ti, 4.4 Al, 0.03 B, Bal Ni.
6. Inconel 625: 0.05 C, 22 Cr, 9 Mo, 4 Cb, 0.2 Ti, 0.2 Al, 3 Fe, Bal Ni.
7. Inconel 718: 0.04 C, 18.6 Cr, 3.1 W, 5 Cb, 0.9 Ti, 0.4 Al, 18.5 Fe, Bal Ni.
8. Inconel X750: 0.04 C, 15 Cr, 0.9 Cb, 2.5 Ti, 0.8 Al, 6.8 Fe, Bal Ni.
9. L 605: 0.1 C, 20 Cr, 10 Ni, 15 W, Bal Co.
10. Haynes 188: 0.1 C, 22 Ni, 22 Cr, 14.5 W, 0.075 La, Bal Co.
11. 347 SS: 0.05 C, 18 Cr, 11 Ni, 0.5 Cb+Ta, Bal Fe.
12. 410 SS: 0.1 C, 12.5 Cr, Bal Fe.
13. Greek Ascoloy: 0.17 C, 13 Cr, 2 Ni, 3 W, Bal Fe.

The braze removal process uses the previously described solution at a temperature of about 75°-150° F. and preferably at a temperature of about 140° F. Lower temperatures reduce the reaction rate considerably while at higher temperatures the solution becomes depleted in nitric acid by reason of evaporation.

This braze removal process is particularly useful in the refurbishment of gas turbine engine parts. Certain engine parts are fabricated and assembled by brazing and some such brazed parts may become worn or damaged in service.

Ultrasonic agitation of the solution has been found to accelerate the braze removal process and hence ultrasonic agitation is preferred for reasons of economy. The present invention may be better understood by reference to the following examples which are meant to be illustrative rather than limiting.

The following examples show the effectiveness of various solution compositions within the scope of the present invention. The examples deal with tests performed on sections of a turbine stator fabricated from Inconel 718 brazed together with a braze compound of 82% gold and 18% nickel. The examples were performed in solutions held at a temperature of 140° F. and the solutions were ultrasonically agitated at a frequency of 18.5 Khz and a power density of about 1 watt/$cm^2$ into a 1 liter container of the solution. All of the solutions contained 500 ml/l of concentrated nitric acid, approximately an 8 molar concentration.

EXAMPLE I

A solution was made up containing 2.5 g/l of copper sulfate and 1.3 g/l ferric chloride in the 8 molar nitric acid base. This solution produced an $SO_4$ concentration of 0.01 mole/l, a Cl concentration of 0.005 mole/l, a Cu concentration of 0.01 mole/l, and an Fe concentration of 0.005 mole/l. This solution completely removed the braze material without attacking the base material in 6 hours. The base material was left in the solution for an additional 24 hours and microscopic examination did not reveal any evidence of base metal attack.

EXAMPLE II

A solution was made up containing 5.0 g/l nickel sulfate and 0.3 g/l ferric chloride in the 8 molar nitric acid base. This solution produced an $SO_4$ concentration of 0.02 mole/l, a Cl concentration of 0.001 mole/l, a Ni concentration of 0.02 mole/l, and an Fe concentration of 0.001 mole/l. This solution completely removed the braze material without attacking the base material in 6 hours. The base material was left in the solution for an additional 24 hours and microscopic examination did not reveal any evidence of base metal attack.

EXAMPLE III

A solution was made up containing 2.1 g/l $H_4Ce(SO_4)_4$ and 2.1 g/l $CrCl_3$ in the 8 molar nitric acid base. This solution produced a $SO_4$ concentration of 0.015 mole/l, a Cl concentration of 0.008 mole/l, a Ce concentration of 0.006 mole/l and a Cr concentration of 0.004 mole/l. This solution completely removed the braze material within 20 hours with negligible base material attack.

EXAMPLE IV

A solution was made up containing 4.45 g/l $CoSO_4$ and 2.1 g/l $CoCl_2$ in the 8 molar nitric acid base. This solution produced a $SO_4$ concentration of 0.010 mole/l, a Cl concentration of 0.008 mole/l, and a Co concentration of 0.016 mole/l. This solution completely removed the braze material within 20 hours with negligible base material attack.

EXAMPLE V

A solution was made up containing 5.1 g/l $NaSO_4$ and 1.4 g/l NaCl in the 8 molar nitric acid base. The solution produced a $SO_4$ concentration of 0.004 mole/l, a Cl concentration of 0.008 mole/l, and a Na concentration of 0.01 mole/l. This solution completely removed the braze material within 20 hours with negligible base material attack.

EXAMPLE VI

A solution was made up containing 2.7 g/l $CuSO_4$ and 0.8 g/l $FeCl_3$ in the 8 molar nitric acid base. This solution produced a $SO_4$ concentration of 0.016 mole/l, a Cl concentration of 0.005 mole/l, a Cu concentration of 0.010 mole/l and a Fe concentration of 0.003 mole/l. This solution completely removed the braze material within 20 hours with negligible base material attack.

EXAMPLE VII

A solution was made up containing 5 g/l $CuSO_4$ and 10 ml/l HCl in the 8 molar nitric acid base. This solution produced a $SO_4$ concentration of 0.030 mole/l, a Cl concentration of 0.12 mole/l, and a Cu concentration of 0.020 mole/l. This solution completely removed the braze material within 20 hours with minimal attack on the base material. This example illustrates that HCl may be used as a source of Cl ions.

EXAMPLE VIII

A solution was made up containing 2.5 ml/l $H_2SO_4$ and 3.0 g/l $FeCl_3$ in the 8 molar nitric acid base. This solution produced a $SO_4$ concentration of 0.045 mole/l, a Cl concentration of 0.020 mole/l, and an Fe concentration of 0.010 mole/l. This solution completely removed the braze material within 20 hours with negligible attack on the base material. This example illustrates that the $SO_4$ ion may be derived from $H_2SO_4$.

EXAMPLE IX

A solution was made up containing 1 ml/l $H_2SO_4$ and 1 ml/l HCl in the 8 molar nitric acid base. This solution produced a $SO_4$ concentration of 0.018 mole/l, a Cl concentration of 0.012 mole/l, with no metal ions present. This solution partly removed the braze material within 20 hours with negligible base metal attack. This example, in conjunction with Examples VII and VIII illustrates the benefits resulting from the inclusion of metal ions in the solution.

EXAMPLE X

A solution was made up containing 5 g/l $Fe_2(SO_4)_3$ and 3.0 g/l $CrCl_3$ in the 8 molar nitric acid base. This solution produced a $SO_4$ concentration of 0.023 mole/l, a Cl concentration of 0.020 mole/l, a Fe concentration of 0.027 mole/l and a Cr concentration of 0.010 mole/l. This solution completely removed the braze material within 12 hours with negligible base metal attack.

The preceding examples have shown that the solutions of the invention can be effective when made up from a wide variety of metal salts. Examples have further shown that an acid may be substituted for one of the salts without adversely affecting the effectiveness of the solution. For commercial reasons and because of its ready availability, solutions based on ferric chloride and copper sulfate are preferred. These solutions have previously been described in Examples I and VI. Solutions based on ferric chloride and copper sulfate with nitric acid have been used to remove gold-nickel braze from Waspalloy, Greek Ascoloy, Type 347 Stainless Steel and Haynes 188. Based on past experiences, it is anticipated that these solutions would be equally successful in removing gold-nickel braze material from Type 410 Stainless Steel, Hastelloy X, Inconel 625, Inconel X750, Astrolloy, IN 100, MAR-M-200 and other similar alloys.

Although this invention has been shown and described with respect to a preferred embodiment thereof, it should be understood by those skilled in the art that various changes and omissions in the form and detail thereof may be made therein without departing from the spirit and scope of the invention.

Having thus described a typical embodiment of our invention, that which we claim as new and desire to secure by Letters Patent of the United States is:

1. A method for removing gold-nickel type braze material from brazed metallic articles selected from the group consisting of stainless steels, cobalt superalloys and nickel superalloys, without significant base metal attack consisting of:

immersing the brazed articles in a heated aqueous solution which contains from about 40 to about 50% concentrated nitric acid, about 0.01 to about 0.1 mole/l sulfate ions, from about 0.005 to about 0.2 mole/l chloride ions, and at least about 0.001 mole/l metal ions, said solution being held at a temperature between about 75° and 150° F., for a period of time sufficient to remove the braze without adversely affecting the metallic article.

2. A process as in claim 1 wherein the solution is ultrasonically agitated to increase the rate of braze material removal.

3. A method as in claim 1 wherein the metal ions are selected from the group consisting of copper, iron, nickel, chrome, cobalt, cerium and sodium and mixtures thereof.

4. A method as in claim 1 wherein the sulfate ion concentration is derived from sulfuric acid and the chloride ion concentration is derived from a metal chloride.

5. A method as in claim 1 wherein the sulfate ion concentration is derived from a metal sulfate and the chloride ion concentration is derived from HCl.

6. A method as in claim 1 wherein the solution contains nitric acid, copper sulfate and ferric chloride.

* * * * *